US005569319A

United States Patent [19]

Klima et al.

[11] Patent Number: 5,569,319

[45] Date of Patent: Oct. 29, 1996

[54] SULFONATED OLEOCHEMICAL DERIVATIVES AS A NEW CLASS OF LUBRICATING/RHEOLOGICAL FLOW MODIFYING COMPOUNDS FOR THE PAPER INDUSTRY

[75] Inventors: Rudolph F. Klima, Lansdale; Joseph D. Rossi, Erdenheim, both of Pa.; Bert Gruber, Bedburg, Germany

[73] Assignee: Henkel Corporation, Plymouth Meeting, Pa.

[21] Appl. No.: 532,947

[22] Filed: Sep. 22, 1995

Related U.S. Application Data

[62] Division of Ser. No. 182,265, Jan. 14, 1994, Pat. No. 5,503,669.

[51] Int. Cl.[6] ..... C09D 191/00

[52] U.S. Cl. ..... 106/243; 162/162; 162/164.1; 162/179

[58] Field of Search ..... 106/243; 162/162, 162/164.1, 179

[56] References Cited

U.S. PATENT DOCUMENTS

| | | | |
|---|---|---|---|
| 2,901,371 | 8/1959 | Arlt, Jr. | 106/243 |
| 3,404,064 | 10/1968 | Feazel | 162/179 |
| 4,343,655 | 8/1982 | Dodd et al. | 106/214 |
| 4,425,452 | 1/1984 | Nakata et al. | 524/47 |
| 4,659,489 | 4/1987 | Hill et al. | 252/40.5 |
| 4,676,836 | 6/1987 | Hill et al. | 106/243 |
| 4,997,479 | 3/1991 | Hou et al. | 106/162 |
| 5,209,778 | 5/1993 | Malloy | 106/243 |
| 5,292,363 | 3/1994 | Hutcheson | 106/243 |
| 5,308,448 | 5/1994 | Behler et al. | 162/7 |

FOREIGN PATENT DOCUMENTS

| | | | |
|---|---|---|---|
| 1922038 | 11/1970 | Germany | 162/179 |
| 2029655 | 12/1971 | Germany | 162/179 |
| 58-087398 | 5/1983 | Japan | 162/158 |
| 60-099099 | 6/1985 | Japan | 162/158 |

*Primary Examiner*—Anthony Green
*Attorney, Agent, or Firm*—Ernest G. Szoke; Wayne C. Jaeschke; Real J. Grandmaison

[57] ABSTRACT

A paper coating composition includes a paper coating color formulation and a lubricating additive selected from the group consisting of: a) sulfonated oleochemical derivatives and b) mixtures of calcium stearate and polymer emulsions.

5 Claims, 15 Drawing Sheets

SULFONATED OLEOCHEMICAL DERIVATIVES AS A NEW CLASS OF LUBRICATING/RHEOLOGICAL FLOW MODIFYING COMPOUNDS FOR THE PAPER INDUSTRY

This application is a division of application Ser. No. 182,265, filed Jan. 14, 1994, now U.S. Pat. No. 5,503,669.

FIELD OF THE INVENTION

The present invention generally relates to a paper coating composition and method of obtaining a paper coating composition of optimum rheology. More particularly, the addition of sulfonated oleochemical derivatives and mixtures of calcium stearate and polymer emulsions to standard paper coating color formulations significantly improves their rheology and runnability during the coating process.

BACKGROUND OF THE INVENTION

One of the many processes employed during the manufacture of paper and paper board products involves the color coating of the paper products. The color coating procedure is used to enhance both the aesthetics and printability of the paper products. This procedure involves applying a particular coating color formulation onto a paper or paper board web as it moves at varying speeds through a coating apparatus. Examples of material found in coating color formulations typically used in the paper industry include pigments, such as Kaolin clay, titanium dioxide, calcium carbonate, silicates, adhesive binders, such as starches, styrene butadiene latex, polyvinyl acetates, and additives, for either improving or modifying specific physical properties and characteristics of the coating color formulation.

In general, a lubricating additive in coating color formulations acts as a plasticizer, reducing the degree of interactions between dispersion particles and the continuous phase of a color formulation. This allows for a more effective separation of water and dispersion particles, thus enhancing exudation of the clay, lubricant and binder particles to the paper surface during coating. In terms of rheology, the color dispersion with the lowest elastic modulus (G') will contain the more effective lubricant. Thus, a preferred lubricant, when added to a paper coating color formulation, should decrease the elastic modulus G' and lower its viscosity to an optimum coating level. On a relative basis, the lubricant that exhibits the greatest loss tangent (G"/g') is ideal. However, the G' should decrease to a greater degree than G", allowing the material to behave more like a fluid than a solid. The rheology of the coating composition affects its runnability, blade pressure, leveling, streaking, shelf life stability, and dusting. Gloss, while affected by rheology, also depends on other parameters such as glass transition temperature, crystallinity, particle size and UV absorption characteristics. Therefore, it is an object of the present invention to provide a lubricating additive which, when added to a standard paper coating color formulation, improves the coating composition's rheology.

One way of determining the effectiveness of a paper coating color formulation is by looking at its "runnability". Runnability is defined in terms of how easy it is to apply a color coating formulation onto paper or paper board during the coating process. Ease of coating is defined by determining either: (1) the lowest blade pressure required to obtain a desired coat weight at the highest coating speed, or (2) the lowest blade pressure as a function of coat weight at constant coating speed for a series of coating color formulations. Consequently, a coating color formulation capable of providing a desired coat weight, at a low blade pressure, and at a high coating speed, on a consistent basis, is deemed to have superior runnability.

A typical paper coating device used in the industry is a short dwell coater. This device applies a coating color formulation onto a paper or paper board web passing through it under pressure, using an instrument known as a doctor blade to control the thickness of the coating being applied onto the web. The paper or paper board web travels through the short dwell coater at a speed of approximately five thousand feet per minute, thus causing a tremendous amount of pressure to be applied onto the blades, since the amount of pressure is a function of velocity. As a result, the coating blades must be changed every few hours. Improving runnability will enable a reduction in blade pressure, thus resulting in significant cost savings relative to equipment wear and downtime. Therefore, it is an object of the present invention to provide a coating composition capable of reducing the blade pressure needed to be applied when coating paper.

Runnability is also determined by a physical inspection of the coated paper and paper board web. A number of undesirable chemical phenomena and physical forces associated with the color coating process detrimentally affect the integrity and uniformity of both the coating color formulation and coating weight being applied. Such problems are commonly encountered in the paper manufacturing industry and result in the costly waste of materials, equipment, manpower, and product. A poorly coated sheet will exhibit uneven coat weight along the cross web direction for a significant distance along the run. This phenomenon is commonly referred to in the industry as a "streak". This is caused when the viscosity of the coating color formulation is too low or the elastic modulus is too high. Conversely, when the viscosity of the coating color formulation is too high, blade pressure must be increased in order to obtain the proper coating weight causing the blade to wear prematurely. Moreover, the above mentioned problems are magnified as the speed of the coating apparatus is increased. Problems relating to viscosity maintenance, calcification, streaking, and whiskering, all of which are considered factors used in determining the runnability or effectiveness of the paper coating color formulation, as it is applied onto paper, are enhanced when the speed of the coating process is increased. These problems ultimately result in a poor quality coated sheet. Hence, obtaining a coating color formulation having optimum viscosity is critical to achieving improved runnability.

Another problem associated with the paper coating process is "dusting", which is defined as the degree of contaminant debris left behind on the supercalender rolls after glossing a given amount of paper. This debris consists of the components of the dry coating color formulation. If the viscosity of the coating color is too low, coating color dewatering will occur, causing binder migration into the base sheet. This will increase the possibility of dusting.

A compound typically employed by the industry in an attempt to overcome these problems during paper coating runs is calcium stearate. This compound, although somewhat effective, fails to significantly inhibit the occurrence of the above-mentioned chemical and physical phenomena. Moreover, its effectiveness is diminished as the speed of the coating process is increased. Therefore, it is an object of the present invention to provide a paper coating composition capable of improving runnability while decreasing the incidence of dusting.

The effectiveness of a lubricant additive when combined with a coating color formulation is also determined by measuring its dry state paper properties. While many dry state paper properties are measured, a few of which include brightness, opacity, and wet and dry pick, the most important for lubrication are gloss and the above-mentioned dusting.

Gloss is a measure of the specular reflected light from a coated sheet of paper at a 75 degree incident angle. A typical gloss value for a coated sheet of lightweight coated paper (LWC) is 50 at approximately 6#/ream coat weight. An improvement of 1 or 2 gloss units is considered significant. Gloss is dependent on coat weight. Therefore, it is an object of the present invention to provide a lubricant additive capable of reducing dusting while increasing gloss during a paper or paper board coating process.

SUMMARY OF THE INVENTION

Other than in the operating examples, or where otherwise indicated, all numbers expressing quantities of ingredients or reaction conditions used herein are to be understood as modified in all instances by the term "about".

It has been found that sulfonated oleochemical derivatives are excellent lubricating and rheological flow modifying compounds for paper coating color compositions. Classes of these compounds include sulfotriglycerides, sulfocarboxylates, oleic acid sulfonates, and hydroxy mixed ether sulfates. Compounds of these types were added to a standard coating color formulation and their rheological behavior was compared to that of two references: a blank (unlubricated) formulation and conventionally used calcium stearate. The sulfonated oleochemical compounds, when combined with standard coating color formulations, lowered the elastic modulus of the base coating color composition which proved to be much lower than the calcium stearate reference. This translates into better runnability of the coating color composition due to a decrease in viscosity.

The present invention provides a paper coating composition, including a paper coating color formulation, combined with a lubricating additive comprising a sulfonated oleochemical derivative selected from the group consisting of a) an oleic acid sulfonate, b) a hydroxy mixed ether sulfate, c) a sulfotriglyceride, and d) a sulfocarboxylate.

With respect to the oleic acid sulfonate, the sulfonation of oleic acid provides a mixture of hydroxy- and alkene-sulfonates. In addition, various isomers according to the position of the sulfonic acid group, the double bond and/or the hydroxy moiety are formed. Generally speaking, oleic acid sulfonates may be obtained by sulfonation of unsaturated $C_{16}$–$C_{22}$ fatty acids with sulfur trioxide using molar ratios of sulfur trioxide to olefinic double bonds present in the fatty acids of 0.8 to 1.2:1 and, more particularly, 0.9 to 1.0:1 and neutralization of the sulfonation products with, for example, an alkali metal such as sodium or potassium, or an alkanolamine such as triethanolamine. The sulfonation may be carried out at temperatures of 15° to 90° C. and, more particularly, at temperatures of 40° to 70° C., with a stream of sulfur trioxide containing 1 to 10% by volume sulfur trioxide which has been diluted with an inert carrier gas.

The hydroxy mixed ether sulfate has the general structural formula I

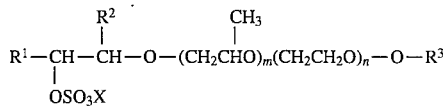

(I)

in which $R^1$ represents a linear or branched alkyl radical having 8 to 16 carbon atoms, $R^2$ represents hydrogen or a linear or branched alkyl radical having 1 to 6 carbon atoms, $R^3$ stands for a linear or branched aliphatic alkyl and/or alkenyl radical having 6 to 22 carbon atoms, m is zero or a number of from 1 to 5, n is a number of from 1 to 20 and x is an alkali metal, an alkaline earth metal, ammonium, alkyl ammonium, alkanol ammonium or glucuammonium. Examples of such hydroxy mixed ether sulfates include butyldiglycol α $C_{14}$-sulfate containing about 0.5 mol ethylene oxide, butyl-monoglycol α $C_{12}$-sulfate containing about 1 mol ethylene oxide, and octanol α $C_{12}$-sulfate containing about 4 mols ethylene oxide.

The sulfotriglyceride component may be obtained by the sulfonation of saturated or unsaturated glycerol esters. Such sulfonation generally provides a complex mixture of various sulfates, sulfonates, and glycerol derivatives. More particularly, the sulfotriglyceride may be obtained by sulfonating a fatty acid glycerol ester with gaseous sulfur trioxide in a falling film reactor to form an acidic reaction product, and then neutralizing the acidic reaction product with an aqueous base material. For example, the fatty acid may be selected from coconut oil or rapeseed oil.

The sulfocarboxylate may include an α-sulfo-$C_8$–$C_{10}$-carboxylic acid disodium salt, an α-sulfo-$C_8$–$C_{10}$-carboxylic acid dimagnesium salt, an α-sulfo-$C_{12}$–$C_{14}$-carboxylic acid dipotassium salt, an α-sulfo-$C_{12}$–$C_{14}$-carboxylic acid dimagnesium salt, and an α-sulfo-$C_{16}$–$C_{18}$-carboxylic acid disodium salt.

Preferably, the lubricating additive is selected from the group consisting of sulfonated rapeseed oil, a hydroxy mixed ether sulfate such as butyldiglycol –0.5 mol ethylene oxide-$C_{14}$-sulfate, and oleic acid sulfonate because better elastic modulus values are obtained therewith.

The addition of sulfonated oleochemical derivatives as lubricating additives to paper coating color formulations significantly improves the runnability of the coating composition. In addition, it is preferred that the coating composition contain approximately 0.2 to about 2 parts of lubricating additive relative to 100 parts of pigment in the coating color formulation. This is about 0.1 to about 1% by weight lubricant solids based on the weight of pigment.

The present invention also provides a method of obtaining a paper coating composition having an optimum coating viscosity, the method comprising adding to a coating color formulation a lubricating additive selected from the aforementioned sulfonated oleochemical derivatives.

It has also been found that lubricating additives comprising mixtures of calcium stearate and various polymer emulsions, while improving the runnability of coating color formulations, also result in a reduction in dusting and an increase in gloss during the paper coating process. Specifically, these lubricating additives comprise dispersions of calcium stearate and a compound selected from the group consisting of a) hydrogenated lard oil, b) a mixture of stearyl ether and oleyl alcohol, c) polyacrylate-polyvinyl acetate copolymer, and d) polyoxyethylene-8-stearate.

When these lubricants were compared to conventional calcium stearate dispersion with regard to their gloss value, it was found that these combinations yielded paper products having higher gloss values.

BRIEF DESCRIPTION OF THE DRAWINGS

In FIG. 1, the designation CS represents calcium stearate; COP represents polyacrylate-polyvinyl acetate copolymer; SE represents stearyl ether-oleyl alcohol; LO represents hydrogenated lard oil; and PEO8S represents polyoxyethylene-8-stearate. It can be seen therefrom that all of the indicated lubricant additive materials provided better gloss values than calcium stearate used alone.

In FIG. 2A PEO represents polyoxyethylene-8-stearate; Ca/HC represents calcium stearate/hydrogenated castor oil; Ca/HL/P represents calcium stearate/hydrogenated lard oil/polyvinyl acetate-polyacrylate copolymer; Ca/StE represents calcium stearate/stearyl ether; Ca/HG represents calcium stearate/HG 74 acrylate latex; PEO/MO represents polyoxyethylene-8-stearate/mineral oil; Sul $R_p$ represents sulfonated rapeseed oil; and Blk represents blank. The gloss values obtained are similar to those from FIG. 1.

In FIG. 2B the representations have the same meaning as those in FIG. 1A. The gloss values obtained are similar to those from FIG. 1. The sulfonated rapeseed oil lubricant is recommended for rotogravure or low starch containing coating colors.

In FIG. 3, the representations have the same meaning as those in FIG. 1A. It can be seen therefrom that, generally speaking, the indicated lubricant additive materials provided better peel strength, i.e., less dusting, than calcium stearate used alone.

FIG. 8 is a bar graph illustrating a comparison of runnability versus high shear viscosity between compositions containing applicant's lubricating additives and those with conventional calcium stearate.

In FIG. 14, He-371 represents octanol-4EO-$\alpha$-$C_{12}$ sulphite; He-376 represents $C_{16}$–$C_{18}$ sulfonated carboxylic acid, disodium salt; LT-074 represents $C_{12}$–$C_{18}$ butyl ether●7EO; and Dy-BS1 represents dehydol LT-$C_{12}$–$C_{18}$ narrow range ethoxylate butyl ether●7EO. For the additives displayed in FIG. 14, rheological performance is approximately equivalent to calcium stearate for the He-371 and He-396 lubricants.

DETAILED DESCRIPTION

Figure 1:
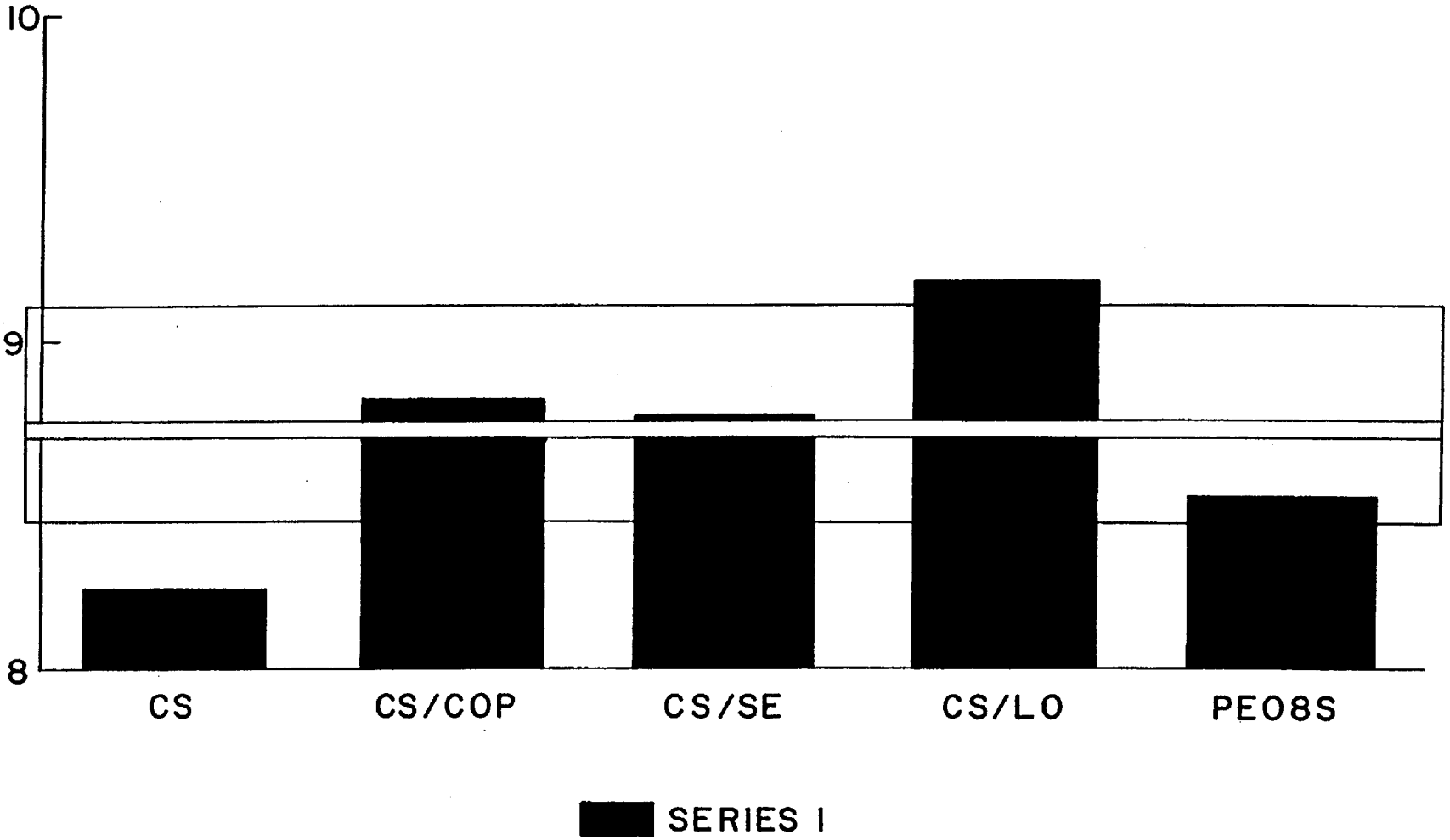
FIG. 1 is a bar graph illustrating gloss values of various coating compositions applied with a cylindrical laboratory coater.
Figure 2A:
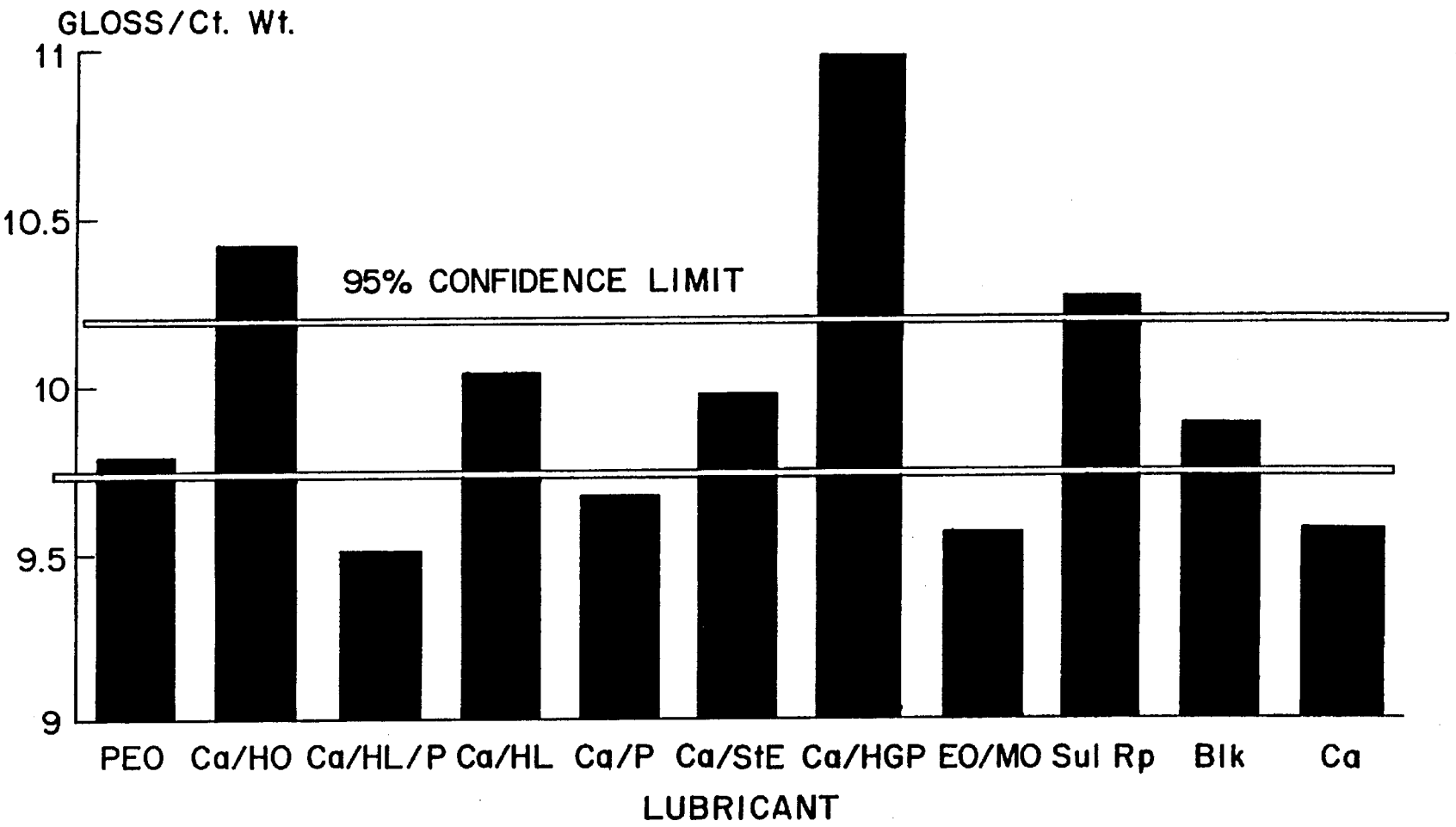
FIG. 2A is a bar graph illustrating laboratory drawdown gloss results for a rotogravure coating color composition.
Figure 2B:
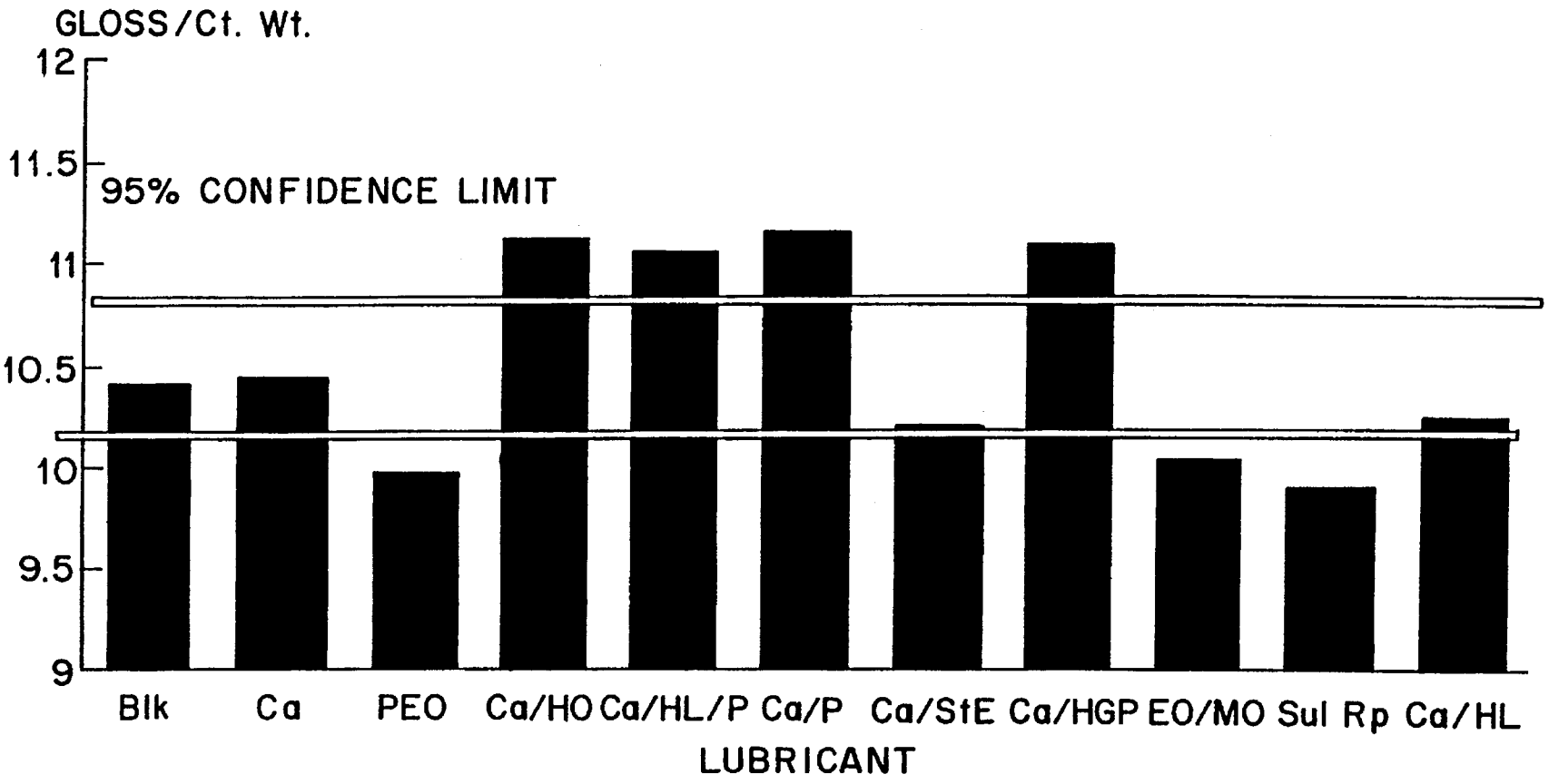
FIG. 2B is a bar graph illustrating laboratory drawdown gloss results for an offset coating color composition.
Figure 3:
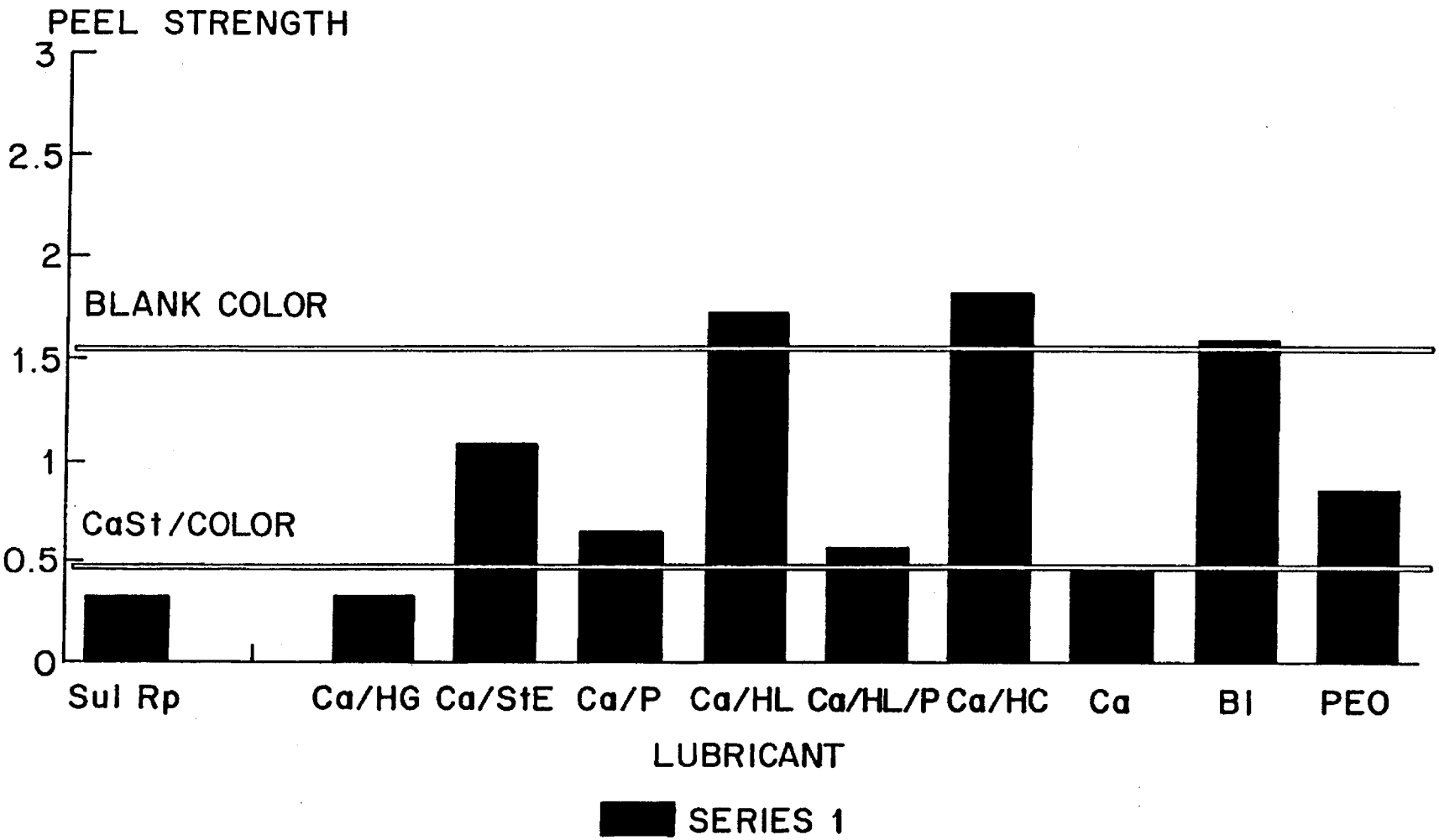
FIG. 3 is a bar graph illustrating the peel strength, i.e., dusting, results for laboratory supercalendered sheets containing the indicated lubricant materials. The peel strength is a measure in force per lineal inch how tenaciously the paper adheres to the calendar roll.

It is desirable to improve the rheology of paper coating color formulations.

It has now been found that by adding sulfonated oleochemical derivatives, acting as lubricating additives, to the paper coating color formulations, their runnability is significantly improved. The addition of these lubricating additives also results in a decrease in pressure required to be applied by the blades onto the web during the coating process, thereby decreasing their wear and downtime.

It has also been found that by adding mixtures comprising calcium stearate and certain polymer emulsions to standard paper coating color formulations, decreased dusting and improved gloss are also obtained.

In one aspect of this invention, there is provided a coating composition for use on short-dwell coaters comprising a paper and paper board coating color formulation combined with a sulfonated oleochemical derivative. The coating color formulation is preferably an aqueous slurry or dispersion adapted for application to a rapidly moving paper web. The coating color formulation employed is one typically known in the industry composed of pigments, such as Kaolin clay, titanium dioxide, calcium carbonate, silicates, adhesive binders such as starches, styrene butadiene latex, or polyvinyl acetates, and additives, which improve or modify specific properties and characteristics of the coating color formulation.

The lubricating additive greatly improves the runnability of the wet coating at high speeds in short dwell coaters, as well as reducing the wear on the blades used to apply the coating color formulation in the short dwell coaters.

This invention allows the use of coating color formulations containing up to about 62% solids by weight. The lubricating additive can be present in an amount of from about 0.1 to about 1% by weight based on the coating composition. This feature allows the coating formulator to prepare coating color formulations at desirable high solids levels and reduces the amount of water present in the formulation which must be subsequently dried after application.

In a preferred embodiment, the lubricating additive is selected from the group consisting of sulfonated rapeseed oil, hydroxy mixed ether sulphates, oleic acid sulphonates, and sulfocarboxylates. For example, these additives may include butyldiglycol-0.5 mol-ethoxylate-$C_{14}$-sulphate, oleic acid sulfonate, and alpha-sulfo-$C_8$–$C_{10}$ carboxylic acid-di-Mg salt.

Preferably, the pH of these coating compositions is from about 8 to about 10.

The coating color composition containing the lubricant additive may be applied to a paper or paper board web traveling at least 500 feet per minute, and generally much faster, for example, up to about 5000 feet per minute. In the short dwell application method, the coating composition is applied to the web under pressure while a blade controls the thickness of the coating composition being applied. The coating composition preferably has a solids content of between about 50 and about 65% by weight, wherein the solids comprise on a weight basis about 7 to about 13% binder, about 75 to about 90% pigment, and about 0.1 to about 1.0% by weight lubricant additive of this invention. The coating composition may also include a plasticizer such as a polyol, examples of which include glycol and dipropylene glycol.

The lubricant can be used in acid, neutral or basic form. The overall pH of the coating color composition will remain between 8 and 10. However, acid form lubricant addition will shock the coating color, if the lubricant pH is more acidic than a pH of 4.5, and will require additional mixing time.

In another aspect of this invention there is provided a method of obtaining a paper coating composition having an optimum coating viscosity comprising adding a lubricating additive to a paper coating color formulation, thus forming a coating composition.

In one embodiment, the lubricating additive is a sulfonated oleochemical derivative. In a preferred embodiment the sulfonated oleochemical derivative is selected from the group consisting of a) sulfonated rapeseed oil, b) butyldiglycol-0.5 mol-ethoxylate-$C_{14}$-sulphate, c) oleic acid sulfonate, and d) alpha-sulfo-$C_8$–$C_{10}$-carboxylic acid-di-Mg salt.

In another aspect of the invention there is provided a coating color composition which, in addition to improving the runnability of the coating color formulation, reduces the incidence of dusting and improves gloss comprising a paper coating color formulation combined with a lubricating additive selected from the group consisting of calcium stearate and hydrogenated lard oil dispersion; calcium stearate with stearyl ether and oleyl alcohol dispersion; calcium stearate with polyacrylate-polyvinyl acetate copolymer dispersion; and polyoxyethylene-8-stearate dispersion.

In a preferred embodiment, the lubricating additive comprises mixtures of from about 5 to about 75% by weight calcium stearate and from 95 to about 25% by weight of the above mentioned polymer dispersions. Also, the pH of these mixtures is preferably from about 4 to about 10. The pH of the coated color composition containing these additives is preferably from about 8 to about 10.

In another aspect of the invention there is provided a method of obtaining a coating composition capable of improving runnability, reducing dusting and improving gloss, the method comprising adding to a standard coating color formulation mixtures of calcium stearate and one of the following: hydrogenated lard oil; stearyl ether- and oleyl alcohol; polyacrylate-polyvinyl acetate copolymer; and polyoxyethylene-8-stearate.

In the examples which follow, the following abbreviations are employed in describing the lubricating additive of the coating composition: MS-1500 is sulfonated rapeseed oil; Py-He-375 is butyldiglycol-0.5-ethoxyl-$C_{14}$-sulphate; Py-He-401 is alpha-Sulfo-$C_8$–$C_{10}$-carboxylic acid-di-Mg salt; Ri-2047 is oleic acid sulfonate ($NH_4^+$ salt); Es-277 is fatty alcohol ethoxylates; POE8S is polyoxyethylene-8-stearate dispersion; CS/LO is calcium stearate/hydrogenated lard oil dispersion; CS/SE is calcium stearate/stearyl ether/oleyl alcohol dispersion; CS/COP is calcium stearate/polyacrylate-polyvinyl acetate copolymer dispersion; CS is conventional calcium stearate dispersion. The following examples are illustrative of the coating compositions and processes of the present invention and will be useful to one of ordinary skill in the art in practicing the invention. However, the invention is in no way limited by these examples.

EXAMPLE 1

In the following, various lubricating additive compositions were evaluated for gloss values. The lubricating additives were employed with a coating color composition comprising about 60 parts by weight of delaminated kaolin clay, 40 parts by weight #2 clay, 8 parts by weight of styrene-butadiene rubber latex, about 8 parts by weight of oxidized starch, about 0.5 parts by weight of sodium polyacrylate as a dispersant, and about 1 part by weight of lubricant additive, with the balance water. The pH of the coating color composition was adjusted to about 9 with NaOH. The lubricating additive, coater speed, coating weight and gloss values employed and found are summarized in Table 1 as follows.

TABLE 1

Gloss Testing Results

| Lubricant | Coater Speed (m/min) | Coat Weight (lbs./book ream) | Gloss/Coat Weight (%/lbs. per book ream) |
|---|---|---|---|
| CS | 1067 | 5.7 | 8.81 |
| | 1220 | 5.8 | 8.71 |
| | 1525 | 5.9 | 8.24 |
| CS/COP | 1067 | 5.8 | 8.71 |
| | 1220 | 5.8 | 8.53 |
| | 1525 | 5.7 | 8.83 |
| CS/SE | 1067 | 5.7 | 9.04 |
| | 1220 | 5.9 | 8.76 |
| | 1525 | 5.8 | 8.77 |
| CS/LO | 1067 | 6.1 | 8.76 |
| | 1220 | 6.1 | 8.71 |
| | 1525 | 5.7 | 9.19 |
| PEO8S | 1067 | 5.9 | 8.60 |
| | 1220 | 6.2 | 8.15 |
| | 1525 | 5.9 | 8.53 |

The highest coater speed results are of greatest importance. They are depicted in the bar graph of FIG. 1. The mean and 90% confidence interval are also shown. Any material showing a greater gloss than this interval is higher in gloss based on statistical analysis using a "t" distribution.

The 90% confidence interval is 8.37 to 9.05 gloss/coat weight as illustrated by 8.71±0.34 gloss/coat weight.

All the formulations tested showed superior gloss results compared to conventional calcium stearate. However, the hydrogenated lard oil/calcium stearate formulation exhibited a statistically verified better gloss than all materials at least 90% of the times tested.

EXAMPLE 2

Figure 4:
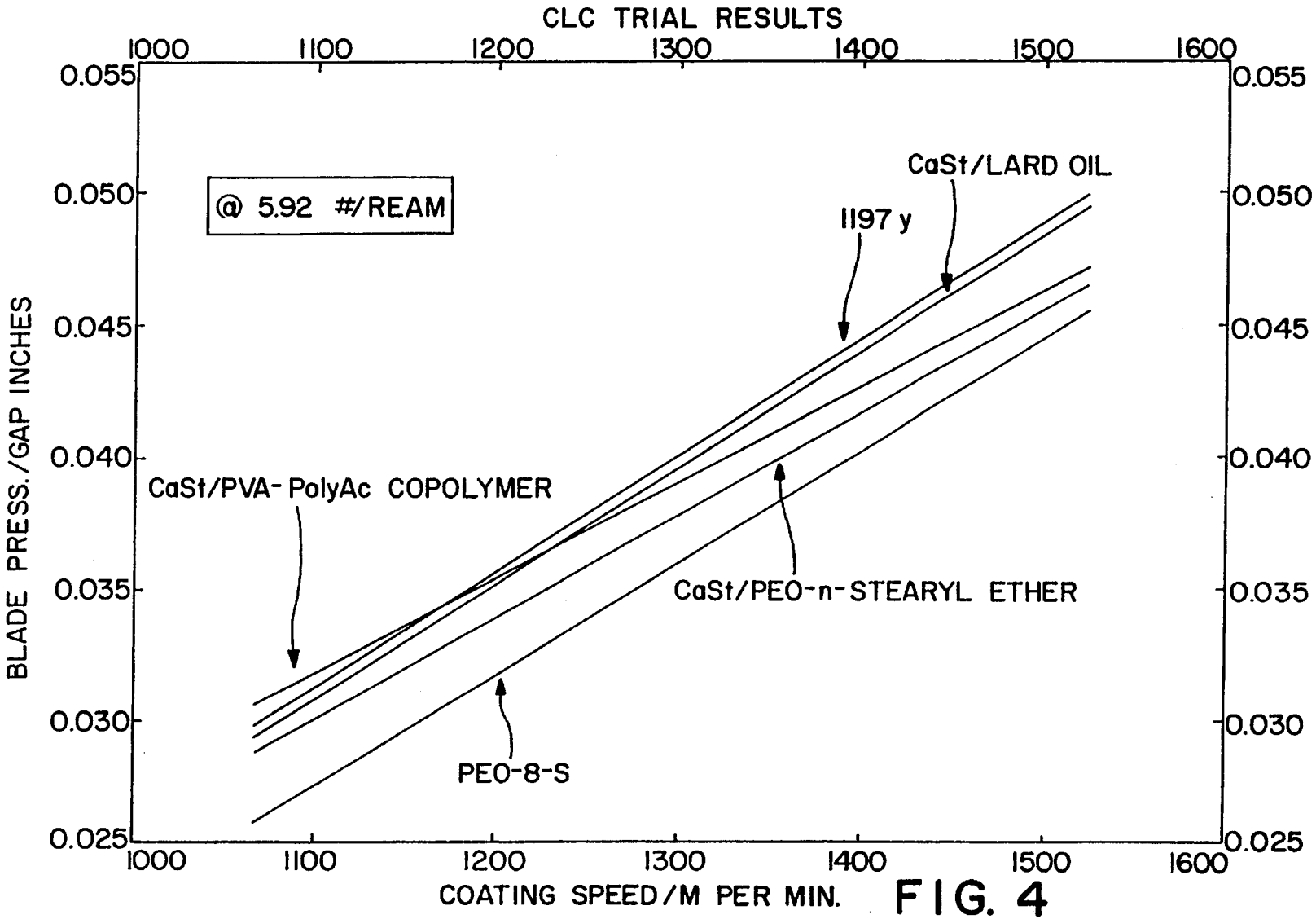
FIG. 4 is a graph illustrating the runnability of various coating compositions determined by measuring blade pressure (gap inches) versus coating speed (M per minute). In FIG. 4
Figure 5:
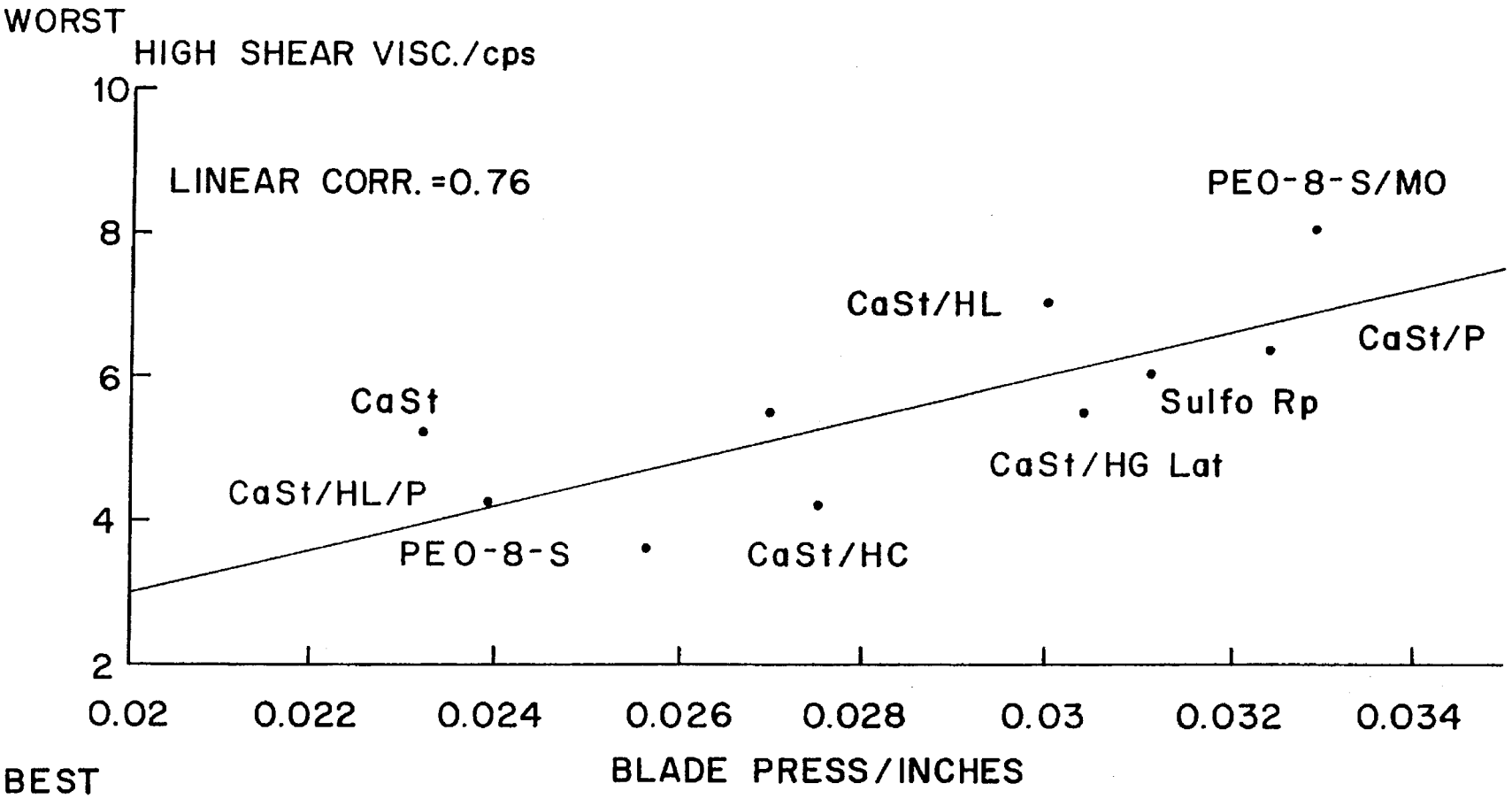
FIG. 5 is a graph illustrating the correlation between high shear viscosity and blade run-in (pressure) of a cylindrical laboratory coater when applying a rotogravure coating color composition in the presence of the indicated lubricant materials. In general, the lubricant allowing the attainment of the lowest blade pressure requirements, to maintain a controllable coat weight, is desirable.

The lubricating additives employed in Example 1 were evaluated for runnability. As previously disclosed herein, runnability is defined in terms of reducing blade pressure during coating a paper web. In FIG. 4, the blade pressure is given as a function of coating speed at constant coat weight. All of the experimental formulations improved the runnability (blade pressure) relative to conventional calcium stearate lubricant. Numerical results are given in Table 2 as follows.

TABLE 2

Runnability Parameters for Coating Color

| Lubricant | Coating Speed (m/min.) | Blade Pressure (Gap Size/inches) |
|---|---|---|
| CS | 1067 | 0.0300 |
| | 1220 | 0.0360 |
| | 1525 | 0.0500 |
| CS/COP | 1067 | 0.0305 |
| | 1220 | 0.0360 |
| | 1525 | 0.0470 |
| CS/SE | 1067 | 0.0295 |
| | 1220 | 0.0355 |
| | 1525 | 0.0465 |
| CS/LO | 1067 | 0.0220 |
| | 1220 | 0.0295 |
| | 1525 | 0.0435 |
| PEO8S | 1067 | 0.0260 |
| | 1220 | 0.0320 |
| | 1525 | 0.0455 |

EXAMPLE 3

The lubricating additives employed in Example 1 were evaluated for rheological properties.

There are many parameters to measure in rheological testing (elastic moduli, yield value, absolute viscosity, Brookfield viscosity, etc.). In a paper mill or coating facility, the Brookfield viscosity is the standard test. All formulations tested had very similar Brookfield viscosities, as shown in Table 3. The PEO8S material had a slightly lower Brookfield viscosity compared to conventional calcium stearate. The Brookfield viscosity is measured at very low shear (speed for a given gap size). In general, coating color viscosity changes as a function of speed.

TABLE 3

Brookfield Viscosity of Color Composition containing 1 part Lubricant

| Lubricant | Brookfield Viscosity @ 100 RPM (cps) |
|---|---|
| CS | 1130 |
| CS/COP | 1426 |
| CS/SE | 1326 |
| CS/LO | 1262 |
| POE8S | 1108 |

High Shear Viscosity

High shear rheology is important because it predicts based on laboratory measurement the runnability experienced during paper coating. The blade pressure is a force per unit area experienced by the coating color composition on the paper web. This force per unit area is a stress. The stress is a function of coating speed and an inverse function of coat weight. In other words, the blade pressure (stress) is a function of coater speed divided by coat weight (shear). These parameters can be related to high shear rheology as follows:

Blade Pressure/(Coater Speed/Coat Weight) =

Viscosity = Stress/shear

Shear =

Coater speed or velocity/velocity gradient length or coat weight.

Figure 6:
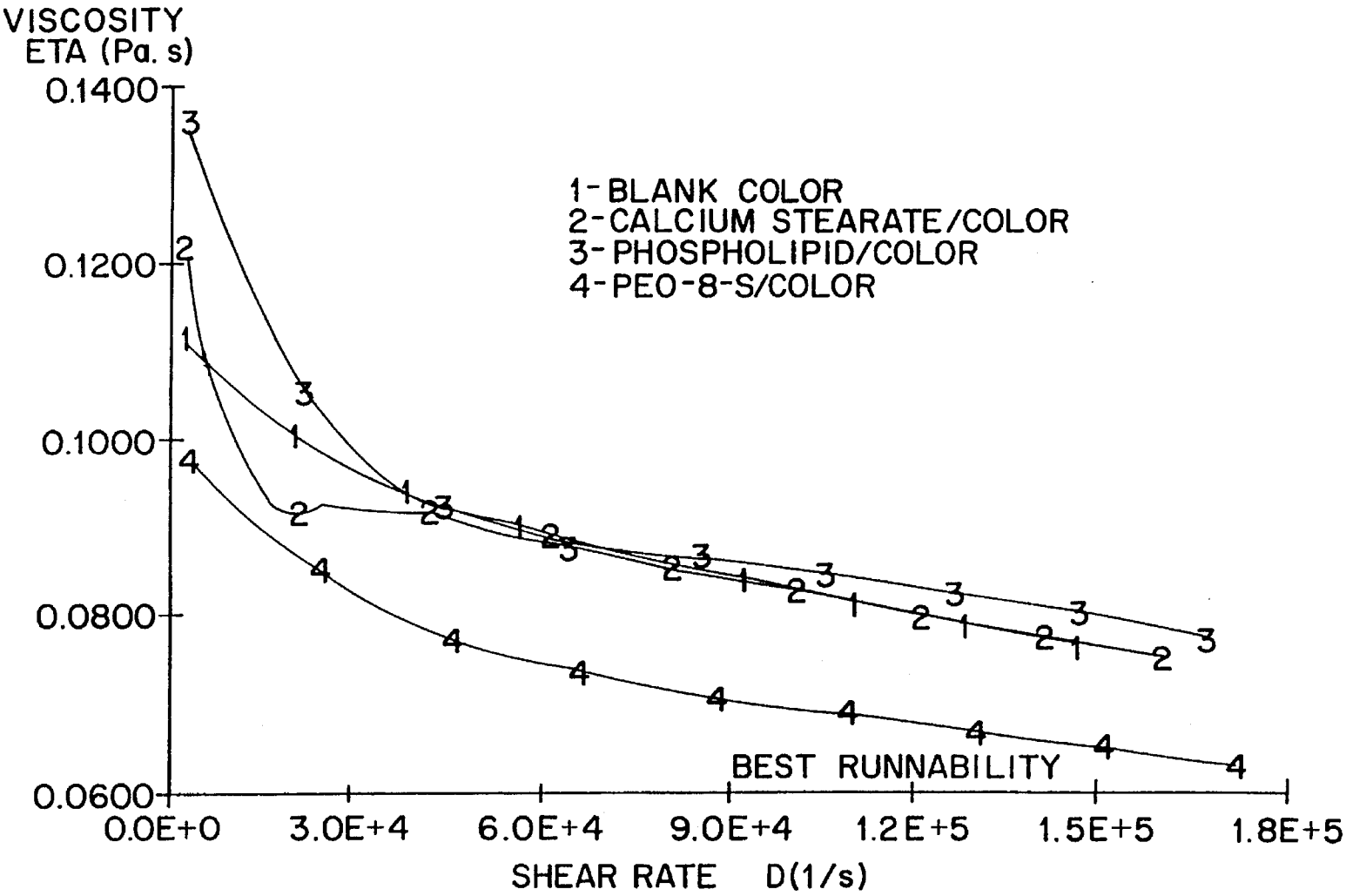
FIG. 6 is a graph illustrating the high shear rheology of various color containing lubricants determined by measuring viscosity versus shear rate.
Figure 7:
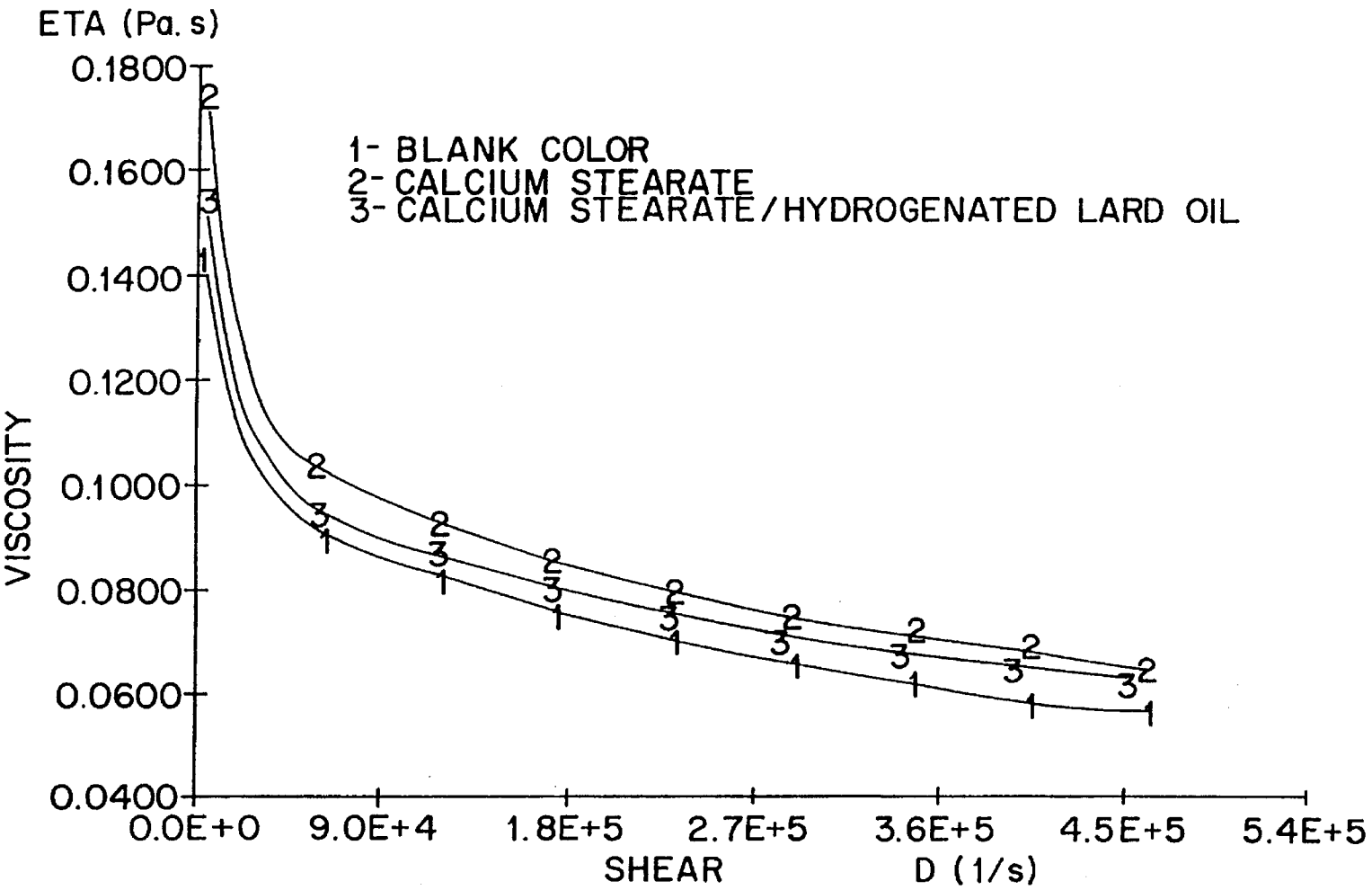
FIG. 7 is a graph illustrating the high shear rheology of various coating compositions by measuring viscosity versus shear. The data in FIGS. 6 and 7 illustrate that the lubricants of this invention lower the viscosity of the coating color relative to equivalent amounts of calcium stearate.
Figure 8:
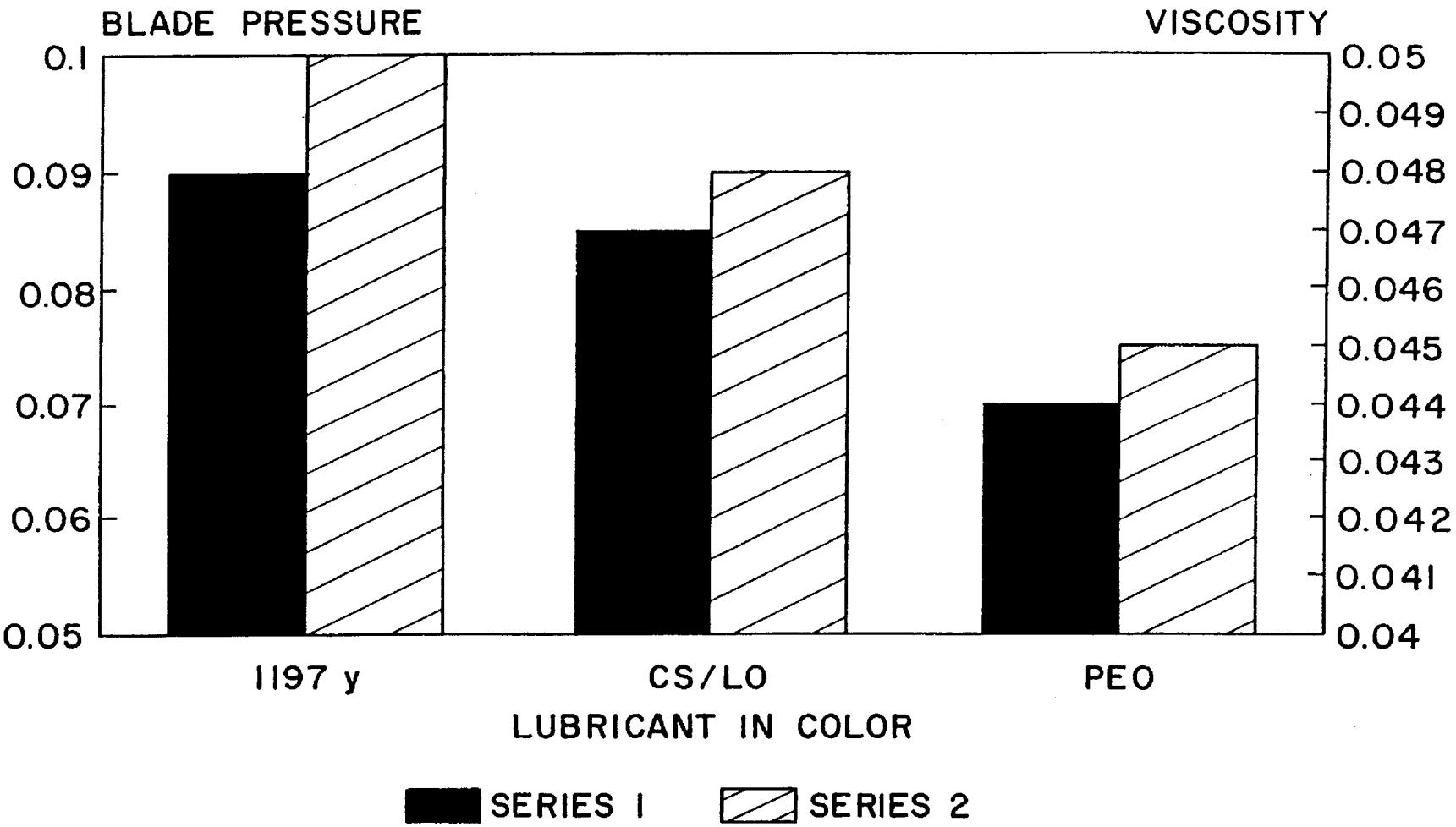
FIG. 8, 1197y represents calcium stearate.

The high shear rheograms of conventional calcium lubricant, as well as the PEO-8-S, and a phospholipid type lubricant in color are given in FIG. 6. Note the blank color is also shown. The calcium stearate lubricant always increases the viscosity of the system and also is known to cause a decrease in the ease of runnability. In fact, there is a direct correlation between high shear viscosity and runnability. This is shown in FIG. 8. The hydrogenated lard oil/calcium stearate lubricant rheological behavior in color is shown in FIG. 7. In general, the lubricants of this invention improve runnability with respect to conventional calcium stearate lubricant.

Oscillation Shear Rheology

Figure 9:
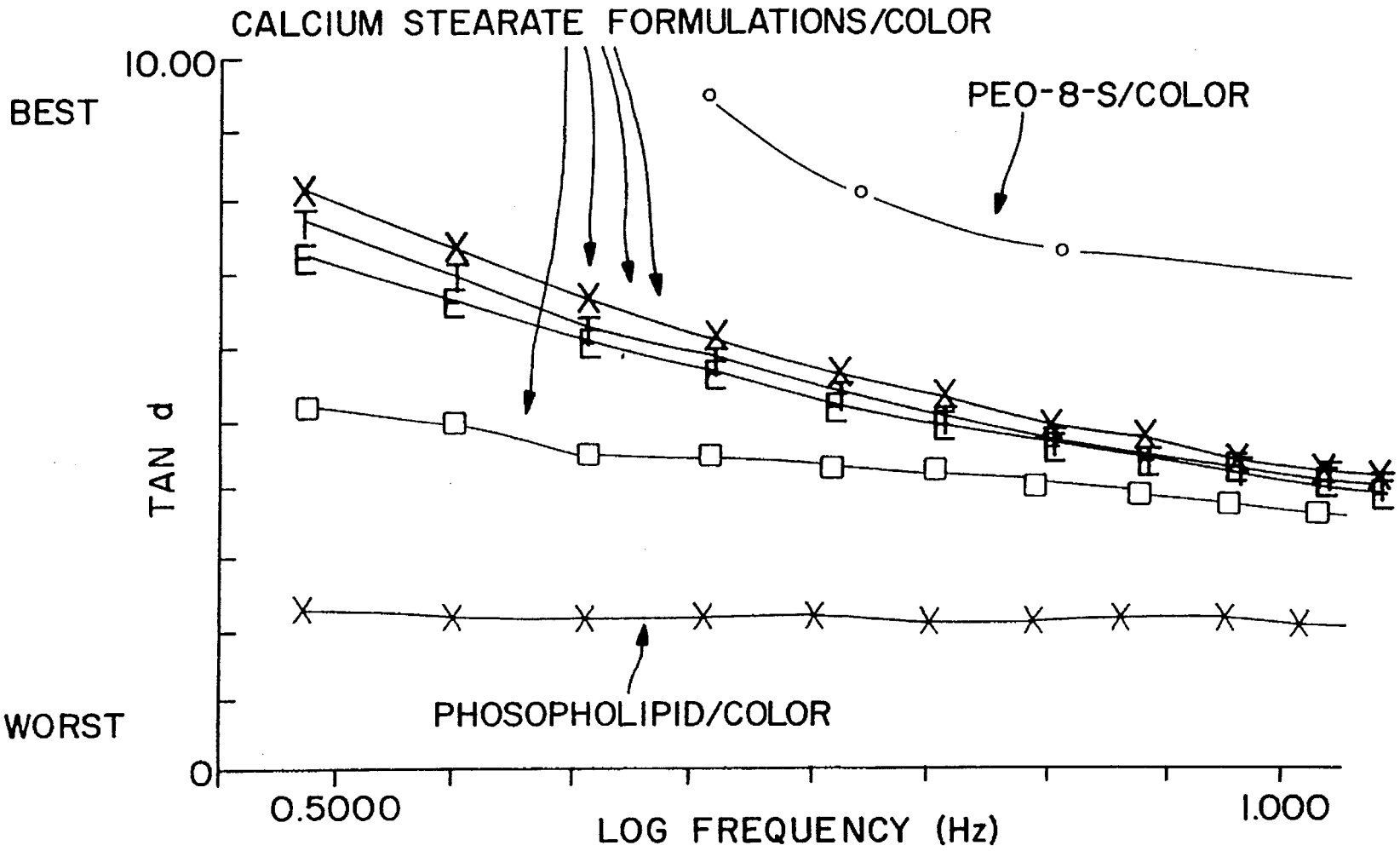
FIG. 9 is a graph illustrating the loss tangent behavior of a series of lubricating additives in terms of lubricating power for two parts of paper lubricant in color. The lubricants proposed in this invention can be used to regulate the ratio of G" to G' to impart the required rheology to the coating color.
Figure 10:
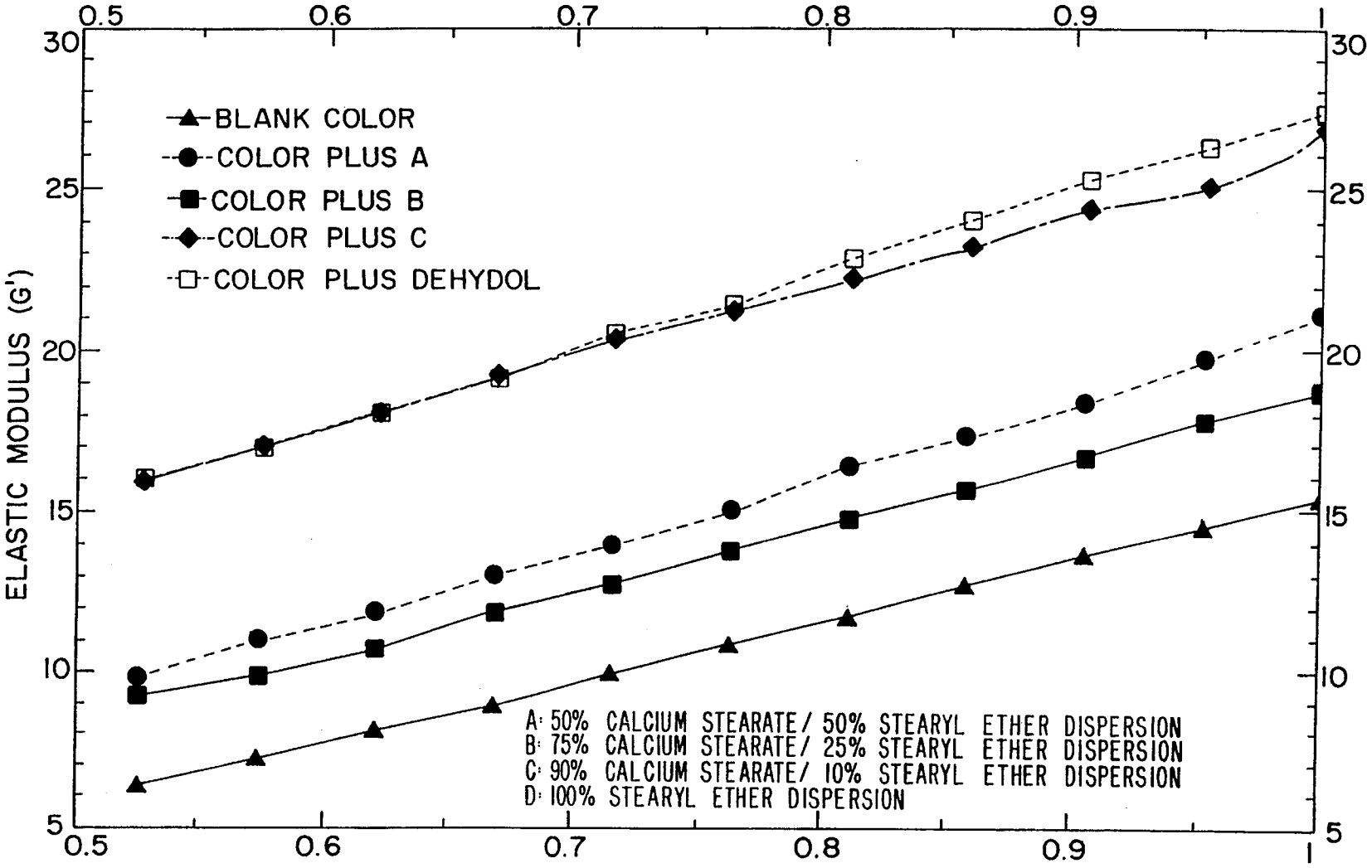
FIG. 10 is a graph illustrating the rheology of various lubricants, including a combination of dehydol and calcium stearate package by measuring elastic modulus (G'), as a function of frequency (Hz). A mixture of dehydol and calcium stearate in the correct proportions can reduce G' and maintain good surface properties.
Figure 11:
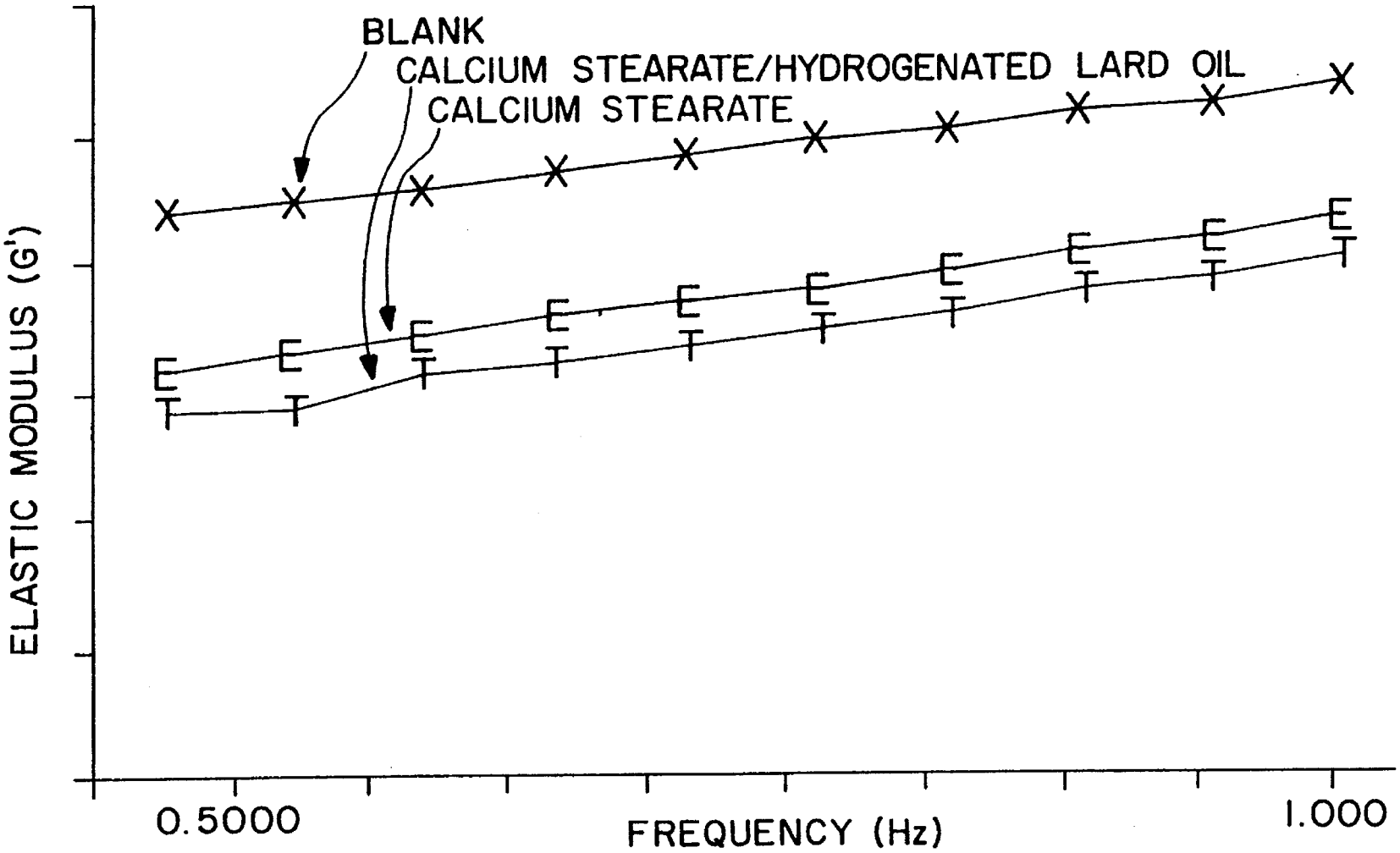
FIG. 11 is a graph illustrating the rheology of a blank, calcium stearate and hydrogenated lard oil, and calcium stearate, respectively, by measuring elastic modulus (G') versus frequency (Hz). The hydrogenated lard oil additive reduces G'.
Figure 12:
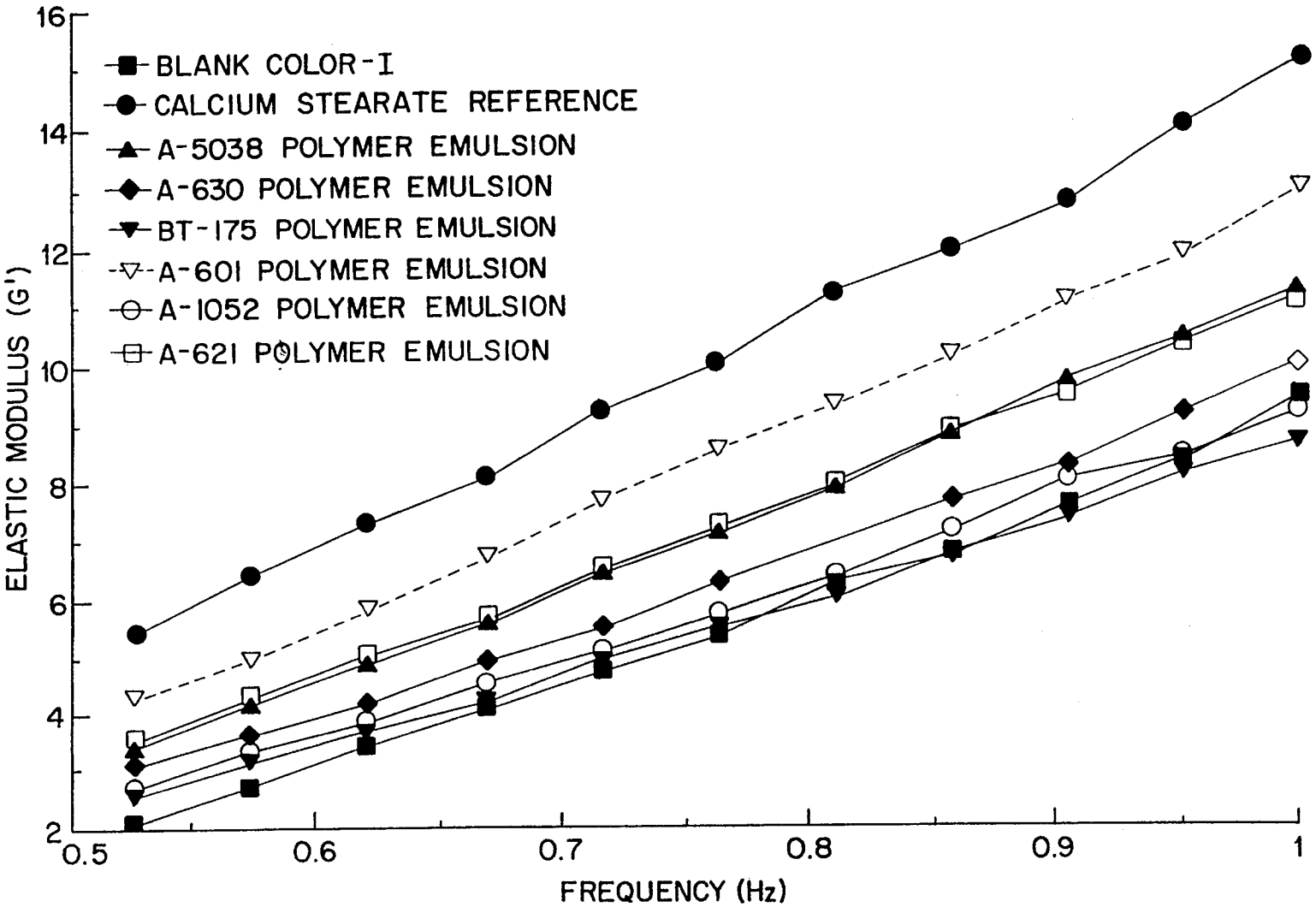
FIG. 12 is a graph illustrating the runnability for coating colors lubricated with mixtures of 75% calcium stearate and 25% polymer emulsion by measuring elastic modulus (G') versus frequency (Hz). All of the additives shown lower G' relative to using calcium stearate or the blank.

The lubricant acts as a plasticizer and reduces the degree of interactions between dispersion particles and the continuous phase in a color formulation. This allows for a more effective separation of water and dispersion particles, thus enhancing exudation of the clay, lubricant and binder particles to the paper surface during coating. In terms of rheology, the color dispersion with the lowest elastic modulus (G') will contain the more effective lubricant. The loss tangent is inversely proportional to G'. The loss tangent behavior of a series of lubricants is shown in FIG. 9. The PEO-8-S formulation appears the best. The stearyl ethers, when added to calcium stearate, exhibit a synergistic effect to lower G' that does not occur for the neat materials when used as lubricants separately. This behavior is depicted in FIG. 10. The elastic modulus behavior of the calcium stearate/hydrogenated lard oil lubricant and the calcium stearate/polyvinyl acetate- polyacrylate copolymer mixture lubricant in color are given in FIGS. 8 and 9, respectively.

In general, in terms of rheology, a material is a good lubricant if, when added to color, it decreases the elastic modulus G' and lowers the viscosity. On a relative basis, the lubricant that exhibits the greatest loss tangent (G"/G') is the best. That is, it exhibits lower viscosity and decreased G', however, the G' decreases to a greater degree than G", allowing the material to behave more like a fluid than a solid. The rheology of the color containing lubricant affects the runnability (blade pressure, leveling, streaking), the shelf life stability (settling), and dusting (pick-up onto calendar roll) the greatest. Gloss, while being affected by rheology, also depends on other parameters such as glass transition temperature, crystallinity, particle size, and UV absorption characteristics.

EXAMPLE 4

Figure 13:
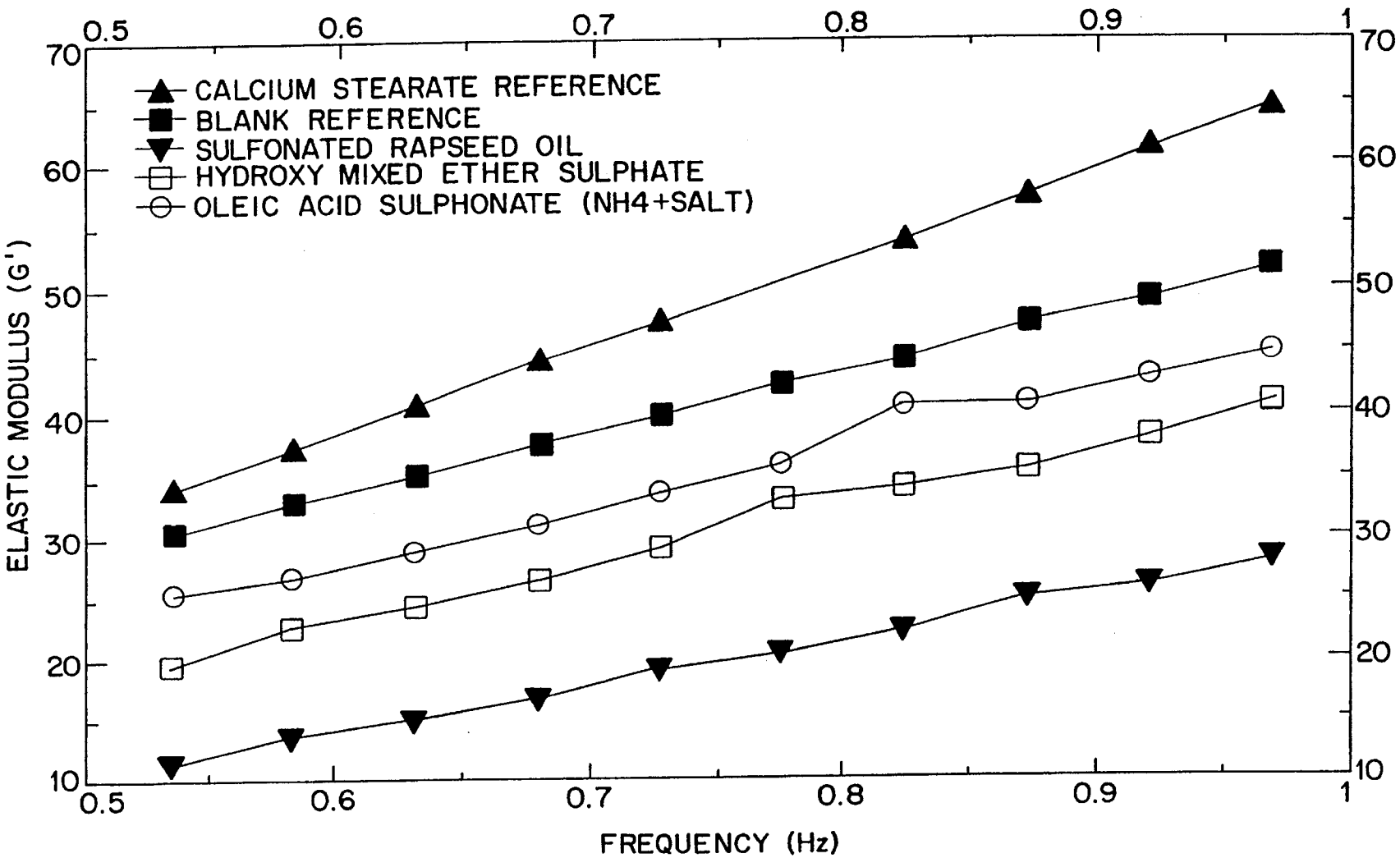
FIG. 13 is a graph illustrating the rheology of various sulfonated oleochemical derivatives by measuring elastic modulus versus frequency (Hz). Again, relative to the same amount of calcium stearate the additives shown reduce G' of the coating color. This lower viscosity response improves runnability.
Figure 14:
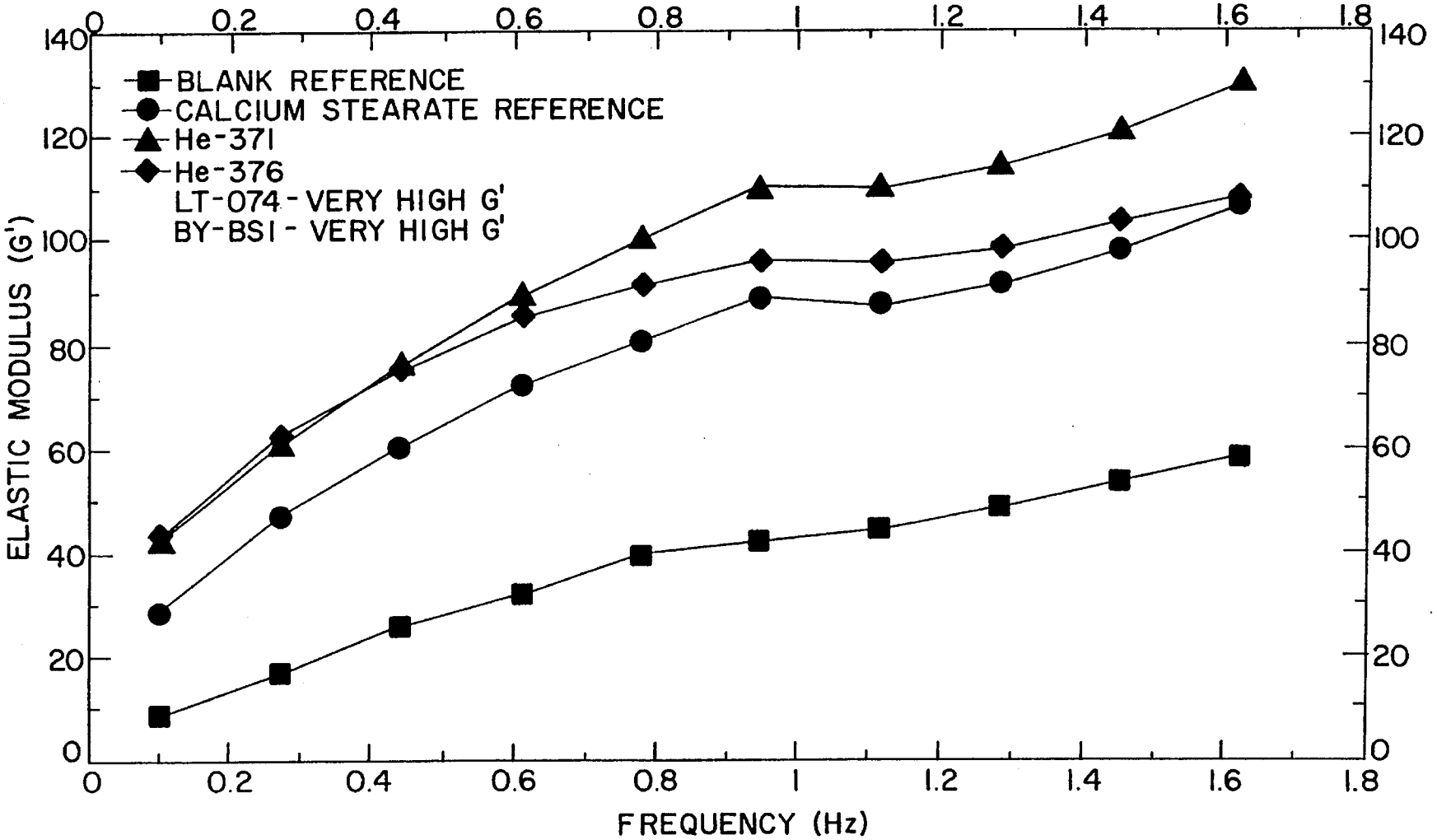
FIG. 14 is a graph illustrating the rheology of various lubricants by measuring elastic modulus (G') versus frequency (Hz).

A series of sulfonated oleochemical derivatives as lubricating additives was added to a standard coating color formulation and their rheological behavior was compared to that of two references, i.e., a blank (unlubricated) and conventional calcium stearate. The rheology values obtained are illustrated in FIG. 13 wherein it can be seen that all the sulfonated oleochemical compounds lowered the elastic modulus of the base coating color composition and proved to be much lower than the calcium stearate reference. The lower elastic modulus values translate into better runnability, particularly on a short-dwell coater. Relative to gloss, a dry-state property of a lubricant, these compounds exhibit gloss values slightly lower than that of the references with the best gloss value falling just short of the gloss value for calcium stearate.

What is claimed is:

1. A coating composition for coating paper and paper board comprising:

a) a paper coating mixture, and b) from about 0.1% to about 1% by weight of a lubricating additive dispersion containing calcium stearate and a compound selected from the group consisting of i) hydrogenated lard oil, ii) a mixture of stearyl ether and oleyl alcohol, iii) polyacrylate-polyvinyl acetate copolymer, and iv) polyoxyethylene-8-stearate, based on the weight of said coating composition.

2. A coating composition according to claim 1 wherein said calcium stearate is present in an amount of from about 5 to about 75% by weight, based on the weight of said lubricating additive dispersion.

3. A composition according to claim 1 having a solids content of between about 50 and about 65% by weight, based on the weight of said composition.

4. The method of improving the rheological properties of a paper coating composition comprising adding to a paper coating mixture from about 0.1% to about 1% by weight of a lubricating additive dispersion containing calcium stearate and a compound selected from the group consisting of a) hydrogenated lard oil, b) a mixture of stearyl ether and oleyl alcohol, c) polyacrylate-polyvinyl acetate copolymer, and d) polyoxyethylene-8-stearate, based on the weight of said coating composition.

5. A method as in claim 4 wherein said calcium stearate is present in an amount of from about 5 to about 75% by weight, based on the weight of said lubricating additive dispersion.

* * * * *